US010570487B2

(12) United States Patent
Takasuga et al.

(10) Patent No.: US 10,570,487 B2
(45) Date of Patent: Feb. 25, 2020

(54) ROLLED STEEL MATERIAL FOR FRACTURE SPLITTING CONNECTING ROD

(71) Applicants: NIPPON STEEL & SUMITOMO METAL CORPORATION, Tokyo (JP); HONDA MOTOR CO., LTD., Tokyo (JP)

(72) Inventors: Motoki Takasuga, Kitakyushu (JP); Yusuke Miyakoshi, Kitakyushu (JP); Tatsuya Hasegawa, Tokyo (JP); Hideki Matsuda, Wako (JP); Masashi Kawakami, Wako (JP); Isamu Saito, Wako (JP)

(73) Assignees: NIPPON STEEL CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 319 days.

(21) Appl. No.: 15/518,035

(22) PCT Filed: Oct. 17, 2014

(86) PCT No.: PCT/JP2014/005274
§ 371 (c)(1),
(2) Date: Apr. 10, 2017

(87) PCT Pub. No.: WO2016/059664
PCT Pub. Date: Apr. 21, 2016

(65) Prior Publication Data

US 2017/0292178 A1 Oct. 12, 2017

(51) Int. Cl.
*C22C 38/50* (2006.01)
*C22C 38/60* (2006.01)
(Continued)

(52) U.S. Cl.
CPC ..... *C22C 38/50* (2013.01); *C21D 8/06* (2013.01); *C22C 38/00* (2013.01); *C22C 38/001* (2013.01); *C22C 38/02* (2013.01); *C22C 38/04* (2013.01); *C22C 38/42* (2013.01); *C22C 38/44* (2013.01); *C22C 38/46* (2013.01); *C22C 38/60* (2013.01); *C21D 7/13* (2013.01); *C21D 2211/004* (2013.01)

(58) Field of Classification Search
CPC ..... C21D 8/06
See application file for complete search history.

(56) References Cited

U.S. PATENT DOCUMENTS 5,135,587 A 8/1992 Olaniran et al.
2009/0120541 A1* 5/2009 Shimamura ..... C21D 8/02 148/593

(Continued)

FOREIGN PATENT DOCUMENTS

JP 2004-301324 10/2004
JP 2004277840 * 10/2004

(Continued)

*Primary Examiner* — Colleen P Dunn
*Assistant Examiner* — Nicholas A Wang
(74) *Attorney, Agent, or Firm* — Clark & Brody

(57) ABSTRACT

A rolled steel material for fracture splitting connecting rods consists of, C: 0.30 to 0.40%, Si: 0.60 to 1.00%, Mn: 0.50 to 1.00%, P: 0.04 to 0.07%, S: 0.04 to 0.13%, Cr: 0.10 to 0.30%, V: 0.05 to 0.14%, Ti: more than 0.15% to 0.20% or less, N: 0.002 to 0.020%, and optionally may contain Cu, Ni, Mo, Pb, Te, Ca, and Bi, with the balance being Fe and impurities. fn1, defined by Formula (1), ranges from 0.65 to 0.80. Relative to the V content in the steel material, a V content in coarse precipitates having a particle size of 200 nm or more is 70% or less, and relative to the Ti content in the steel material, a Ti content in the coarse precipitates is 50% or more.

$$fn1 = C + Si/10 + Mn/5 + 5Cr/22 + (Cu+Ni)/20 + Mo/2 + 33V/20 - 5S/7 \quad (1)$$

4 Claims, 1 Drawing Sheet

(51) Int. Cl.

| | |
|---|---|
| ***C22C 38/00*** | (2006.01) |
| ***C21D 8/06*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| *C21D 7/13* | (2006.01) |

(56) References Cited

U.S. PATENT DOCUMENTS

| | | | | |
|---|---|---|---|---|
| 2009/0277539 | A1* | 11/2009 | Kimura | C21D 8/0205<br>148/504 |
| 2010/0147424 | A1* | 6/2010 | Murota | C21D 8/0226<br>148/621 |
| 2012/0107633 | A1* | 5/2012 | Nakagawa | C21D 8/0226<br>428/577 |
| 2014/0178242 | A1* | 6/2014 | Sano | C21D 8/065<br>420/87 |

FOREIGN PATENT DOCUMENTS

| | | |
|---|---|---|
| JP | 2010-180473 | 8/2010 |
| JP | 2011-084767 | 4/2011 |
| JP | WO2012157455 | * 11/2012 |
| WO | 2012/157455 | 11/2012 |
| WO | 2012/164710 | 12/2012 |

* cited by examiner

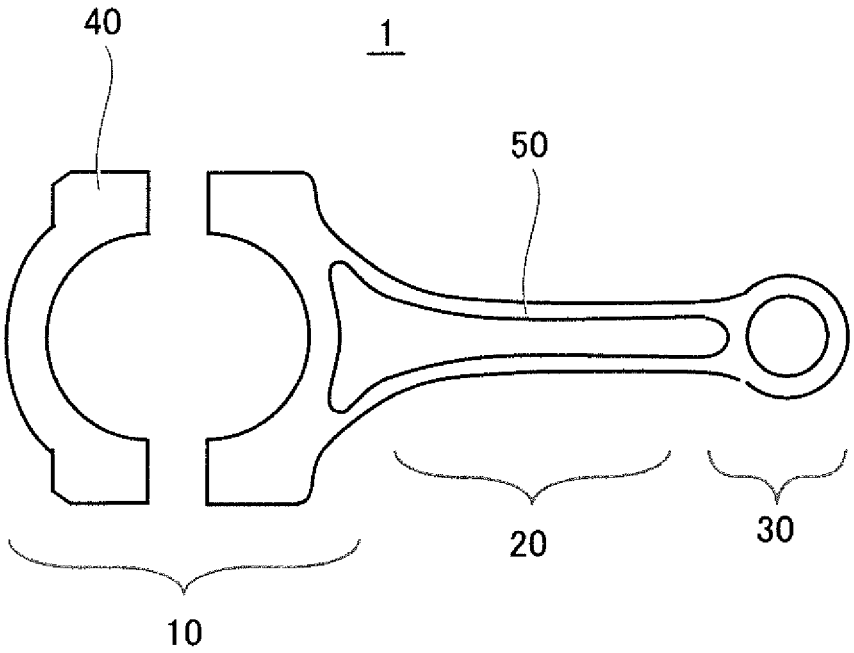
40
1
50
20
30
10

ROLLED STEEL MATERIAL FOR FRACTURE SPLITTING CONNECTING ROD

TECHNICAL FIELD

The present invention relates to steel materials, and more particularly relates to a rolled steel material for fracture splitting connecting rods.

BACKGROUND ART

Connecting rods are used in engines of, for example, automobiles. The connecting rod couples a piston to a crankshaft to convert the vertical motion of the piston to the rotational motion of the crankshaft.

FIG. 1 is a front view of a conventional connecting rod 1. As illustrated in FIG. 1, the conventional connecting rod 1 includes a big end portion 10, a rod portion 20, and a small end portion 30. The big end portion 10 is disposed at one end of the rod portion 20 and the small end portion 30 is disposed at the other end of the rod portion 20. The big end portion 10 is coupled to a crank pin. The small end portion 30 is coupled to a piston.

The conventional connecting rod 1 includes two parts (a cap 40 and a rod 50). The cap 40 and one end of the rod 50 correspond to the big end portion 10. The other portions than the one end of the rod 50 correspond to the rod portion 20 and the small end portion 30.

The big end portion 10 and the small end portion 30 are formed by machining. Thus, the connecting rod 1 needs to exhibit high machinability.

Furthermore, during operation of the engine, the connecting rod 1 is subjected to loading from nearby components. Furthermore, for fuel saving, there have been needs in recent years for size reduction of the connecting rod 1 and an increase in cylinder pressure within the cylinder. Accordingly, there is a need for the connecting rod 1 to have a thinner rod portion 20 and at the same time be able to exhibit high buckling strength sufficient to withstand the explosive loading transmitted from the piston. The buckling strength heavily depends on the yield strength of the material. Thus, connecting rods need to exhibit high yield strength as well as high machinability.

In the conventional connecting rod 1, the cap 40 and the rod 50 are separately produced as described above. Thus, for positioning of the cap 40 and the rod 50, a dowel pinning process is performed. Furthermore, a machining process is applied to the mating surfaces of the cap 40 and the rod 50. In view of this, fracture splitting connecting rods, which make it possible to eliminate these processes, are increasingly being employed.

A fracture splitting connecting rod is formed by forming a one-piece connecting rod and then fracturing the big end portion thereof into two parts (corresponding to the cap 40 and the rod 50). When mounting it to an engine, the split two parts are joined together. Thus, the dowel pinning process and the machining process are not performed. This results in reduced production cost.

Technologies relating to a steel material for such a fracture splitting connecting rod and a method for producing such a fracture splitting connecting rod are disclosed in U.S. Pat. No. 5,135,587 (Patent Literature 1), Japanese Patent Application Publication No. 2010-180473 (Patent Literature 2), Japanese Patent Application Publication No. 2004-301324 (Patent Literature 3), International Application Publication No. WO 2012/164710 (Patent Literature 4), Japanese Patent Application Publication No. 2011-084767 (Patent Literature 5), and International Application Publication No. WO 2012/157455 (Patent Literature 6).

Patent Literature 1 discloses the following. A steel for fracture splitting connecting rods contains, in weight %, C: 0.6 to 0.75%, Mn: 0.25 to 0.50%, and S: 0.04 to 0.12%, the balance being Fe and up to 1.2% of impurities. Mn/S is 3.0 or more. The steel has a 100% pearlitic structure and a grain size of 3 to 8 ASTM per Specification E112-88.

Patent Literature 2 discloses the following. A steel for fracture splitting connecting rods is a non-heat treated steel made up of ferrite and pearlite and containing 0.20 to 0.60% of C in mass %. The rod portion is subjected to a coining process. The steel for fracture splitting connecting rods contains C, N, Ti, Mn, and Cr as essential elements and contains Si, P, S, V, Pb, Te, Ca, and Bi as optional elements. The essential elements include, in mass %, 0.30 to 1.50% of Mn, 0.05 to 1.00% of Cr, 0.005 to 0.030% of N, and 0.20% or less of Ti. The formula, $Ti \geq 3.4N+0.02$, is satisfied. The 0.2% proof stress of the big end portion is lower than 650 MPa. Further, the 0.2% proof stress of the rod portion, which has been subjected to the coining process, is higher than 700 MPa.

Patent Literature 3 discloses the following. A non-heat treated connecting rod contains, in mass %, C: 0.25 to 0.35%, Si: 0.50 to 0.70%, Mn: 0.60 to 0.90%, P: 0.040 to 0.070%, S: 0.040 to 0.130%, Cr: 0.10 to 0.20%, V: 0.15 to 0.20%, Ti: 0.15 to 0.20%, and N: 0.002 to 0.020%, the balance being Fe and impurities. The Ceq value defined by Formula (1) is less than 0.80. The structure of the big end portion is made up of ferrite and pearlite. The total hardness of the big end portion ranges from 255 to 320 on the Vickers hardness scale. Further, the hardness of the ferrite of the big end portion is 250 or more on the Vickers hardness scale. Further, the hardness of the ferrite relative to the total hardness of the big end portion is 0.80 or more.

$$Ceq = C+(Si/10)+(Mn/5)+(5Cr/22)+1.65V-(5S/7) \quad (1)$$

Patent Literature 4 discloses the following. A non-heat treated steel bar for connecting rods contains, in mass %, C: 0.25 to 0.35%, Si: 0.40 to 0.70%, Mn: more than 0.65% to 0.90% or less, P: 0.040 to 0.070%, S: 0.040 to 0.130%, Cr: 0.10 to 0.30%, Cu: 0.05 to 0.40%, Ni: 0.05 to 0.30%, Mo: 0.01 to 0.15%, V: 0.12 to 0.20%, Ti: more than 0.150 to 0.200% or less, Al: 0.002 to 0.100%, and N: 0.020 or less, the balance being Fe and impurities. Fn1, defined by the formula below, ranges from 0.60 to 0.80, and Fn2, defined by the formula below is 7 or more. In the structure of the non-heat treated connecting rod steel, the ferrite and pearlite structure accounts for 90% or more. The proportion of the ferrite in the ferrite and pearlite structure is 40% or more.

$$Fn1 = C(Si/10)+(Mn/5)+(5Cr/22)+1.65V-(5S/7)+(Cu/33)+(Ni/20)+(Mo/10)$$

$$Fn2 = (Mn\ Ti)/S$$

Patent Literature 5 discloses the following. A method for producing a fracture splitting connecting rod includes: a step of providing a steel material; a step of heating the steel material to a temperature ranging from 1200° C. to 1300° C.; a step of hot forging the steel material into a rough forged body, the step being carried out by applying compression to the steel material at at least a predetermined portion thereof at a temperature of 1000° C. or more and at a working ratio of 50% or more; and a step of cooling the rough forged body at at least 5° C./s or less to form a ferrite and pearlite structure therein. The resulting fracture splitting connecting rod contains, in mass %, C: 0.16 to 0.35%, Si: 0.1 to 1.0%, Mn: 0.3 to 1.0%, P: 0.040 to 0.070%, S: 0.080 to 0.130%, V: 0.10 to 0.35%, and Ti: 0.08 to 0.20%. The hardness of the predetermined portion is at least 250 HV or more.

Further, Patent Literature 6 discloses a non-heat treated steel having a low V content. Specifically, Patent Literature 6 discloses the following. The non-heat treated steel contains, in mass %, C: 0.27 to 0.40%, Si: 0.15 to 0.70%, Mn: 0.55 to 1.50%, P: 0.010 to 0.070%, S: 0.05 to 0.15%, Cr: 0.10 to 0.60%, V: 0.030% or more to less than 0.150%, Ti: more than 0.100% to 0.200% or less, Al: 0.002 to 0.050%, and N: 0.002 to 0.020%, the balance being Fe and impurities. Et, defined by the formula below, is less than 0. Ceq, defined by the formula below, is more than 0.60 to less than 0.80.

$$Et=[Ti]-3.4[N]-1.5\ [S]$$

$$Ceq=[C]+([Si]/10)+([Mn]/5)+(5\ [Cr]/22)+(33\ [V]/20)-(5\ [S]/7)$$

The steel for fracture splitting connecting rods of Patent Literature 1 has been widely commercialized in Europe. However, the steel for fracture splitting connecting rods of Patent Literature 1 may have low yield strength and machinability in some cases.

The steel for fracture splitting connecting rods disclosed in Patent Literature 2 has high yield strength. However, it may have low fracture splittability in some cases.

Furthermore, production conditions for hot forging, e.g., the heating temperature prior to hot forging, may vary from production site to production site. If a fracture splitting connecting rod is produced using any of the steel materials and the production methods disclosed in Patent Literatures 1 to 6 with the heating temperatures prior to hot forging being non-uniform, the fracture splitting connecting rod, in some cases, has a low fracture splittability, low yield strength, or low machinability.

SUMMARY OF INVENTION

An object of the present invention is to provide a rolled steel material for fracture splitting connecting rods which has high fracture splittability, high yield strength and high machinability after hot forging even if the heating temperatures for the hot forging are non-uniform.

A rolled steel material for fracture splitting connecting rods according to the present embodiment has a chemical composition consisting of, in mass %, C: 0.30 to 0.40%, Si: 0.60 to 1.00%, Mn: 0.50 to 1.00%, P: 0.04 to 0.07%, S: 0.04 to 0.13%, Cr: 0.10 to 0.30%, V: 0.05 to 0.14%, Ti: more than 0.15% to 0.20% or less, N: 0.002 to 0.020%, Cu: 0 to 0.40%, Ni: 0 to 0.30%, Mo: 0 to 0.10%, Pb: 0 to 0.30%, Te: 0 to 0.30%, Ca: 0 to 0.010%, and Bi: 0 to 0.30%, the balance being Fe and impurities, wherein fn1, defined by Formula (1), ranges from 0.65 to 0.80. Relative to the V content in the rolled steel material for fracture splitting connecting rods, a V content in coarse precipitates having a particle size of 200 nm or more is 70% or less. Relative to the Ti content in the rolled steel material for fracture splitting connecting rods, a Ti content in the coarse precipitates is 50% or more.

$$fn1=C+Si/10+Mn/5+5Cr/22+(Cu+Ni)/20+Mo/2+33V/20-5S/7 \qquad \text{Formula (1)}$$

where each element symbol in Formula (1) is substituted by the content (mass %) of a corresponding element or is substituted by "0" in a case where the corresponding element is not present.

The rolled steel material for fracture splitting connecting rods according to the present embodiment exhibits high fracture splittability, high yield strength and high machinability after hot forging even if the heating temperatures for the hot forging are non-uniform.

BRIEF DESCRIPTION OF DRAWINGS

FIG. 1 is a side view of a conventional connecting rod.

DESCRIPTION OF EMBODIMENTS

A rolled steel material for fracture splitting connecting rods according to the present embodiment has a chemical composition consisting of, in mass %, C: 0.30 to 0.40%, Si: 0.60 to 1.00%, Mn: 0.50 to 1.00%, P: 0.04 to 0.07%, S: 0.04 to 0.13%, Cr: 0.10 to 0.30%, V: 0.05 to 0.14%, Ti: more than 0.15% to 0.20% or less, N: 0.002 to 0.020%, Cu: 0 to 0.40%, Ni: 0 to 0.30%, Mo: 0 to 0.10%, Pb: 0 to 0.30%, Te: 0 to 0.30%, Ca: 0 to 0.010%, and Bi: 0 to 0.30%, the balance being Fe and impurities, wherein fn1, defined by Formula (1), ranges from 0.65 to 0.80. Relative to the V content in the rolled steel material for fracture splitting connecting rods, a V content in coarse precipitates having a particle size of 200 nm or more is 70% or less. Relative to the Ti content in the rolled steel material for fracture splitting connecting rods, a Ti content in the coarse precipitates is 50% or more.

$$fn1=C+Si/10+Mn/5+5Cr/22+(Cu+Ni)/20+Mo/2+33V/20-5S/7 \qquad \text{Formula (1)}$$

where each element symbol in Formula (1) is substituted by the content (mass %) of the corresponding element or is substituted by "0" in the case where the corresponding element is not present.

In the rolled steel material for fracture splitting connecting rods according to the present embodiment, fn1, which is defined by Formula (1), is within the range of 0.65 to 0.80. As a result, excellent yield strength and machinability are achieved.

Furthermore, relative to the V content in the rolled steel material for fracture splitting connecting rods, a V content in coarse precipitates having a particle size of 200 nm or more is 70% or less. In such a case, fine V precipitates (V-containing precipitates) having a particle size of less than 200 nm are present in large amounts in the rolled steel material for fracture splitting connecting rods. Fine V precipitates readily dissolve during heating in the hot forging process. Thus, even if the heating temperature in the hot forging process is low (e.g., approximately 1000° C.), V readily dissolves by heating. The dissolved V precipitates as carbides in the cooling process of the hot forging. As a result, the hot forged steel material exhibits consistently excellent yield strength even if the heating temperatures in the hot forging process are non-uniform.

Furthermore, relative to the Ti content in the rolled steel material for fracture splitting connecting rods, a Ti content in the coarse precipitates is 50% or more. In the present embodiment, Ti forms sulfides and carbo-sulfides to increase the machinability of the steel. Furthermore, Ti partially dissolves in the steel during heating in the hot forging process. The dissolved Ti forms carbides during subsequent cooling to embrittle the ferrite and thereby increase the fracture splittability. However, if Ti dissolves in excessive amounts during heating in the hot forging process, the steel material after being cooled will have a bainite structure. This results in a decrease in the fracture splittability. In addition, if Ti dissolves in excessive amounts, the steel material will have excessively high tensile strength and therefore have decreased machinability. Thus, it is preferred that excessive dissolution of the Ti precipitates (Ti-containing precipitates) during heating in the hot forging process be inhibited. When the relative Ti content in the coarse precipitates is not less than 50%, fine Ti precipitates are present in the steel in sufficiently small amounts. As a result, even if the heating temperature in the hot forging process is high (e.g., 1280° C.), the Ti precipitates do not readily dissolve (i.e., Ti does not readily dissolve) and therefore decreases in fracture splittability and machinability are inhibited.

As a result of the above, the rolled steel material for fracture splitting connecting rods according to the present embodiment exhibits high fracture splittability, high yield strength and high machinability after hot forging even if the heating temperatures for the hot forging are non-uniform.

The chemical composition mentioned above may contain one or more selected from the group consisting of, Cu: 0.01 to 0.40%, Ni: 0.01 to 0.30%, and Mo: 0.01 to 0.10%. Furthermore, the chemical composition mentioned above may contain one or more selected from the group consisting of, Pb: 0.05 to 0.30%, Te: 0.0003 to 0.30%, Ca: 0.0003 to 0.010%, and Bi: 0.0003 to 0.30%.

A rolled steel material for fracture splitting connecting rods according to the present embodiment will be described in detail below. "Percent" used for the contents of the elements means "mass percent".

[Chemical Composition]

The chemical composition of the rolled steel material for fracture splitting connecting rods according to the present embodiment contains the following elements.

C: 0.30 to 0.40%

Carbon (C) increases the strength of the steel. If the C content is too low, this advantageous effect cannot be produced. On the other hand, if the C content is too high, the hardness of the steel material will increase, which will result in a decrease in machinability. Accordingly, the C content ranges from 0.30 to 0.40%. The lower limit of the C content is preferably more than 0.30%, more preferably 0.31%, and even more preferably 0.32%. The upper limit of the C content is preferably less than 0.40%, more preferably 0.39%, and even more preferably 0.38%.

Si: 0.60 to 1.00%

Silicon (Si) deoxidizes the steel. In addition, Si dissolves in the steel and thereby increases the strength of the steel. If the Si content is too low, this advantageous effect cannot be produced. On the other hand, if the Si content is too high, the above advantageous effects reach saturation. In addition, if the Si content is too high, the hot workability of the steel will decrease and the cost of producing the steel material will increase. Accordingly, the Si content ranges from 0.60 to 1.00%. The lower limit of the Si content is preferably more than 0.60%, more preferably 0.62%, and even more preferably 0.65%. The upper limit of the Si content is preferably less than 1.00%, more preferably 0.95%, and even more preferably 0.90%.

Mn: 0.50 to 1.00%

Manganese (Mn) deoxidizes the steel. In addition, Mn increases the strength of the steel. If the Mn content is too low, these advantageous effects cannot be produced. On the other hand, if the Mn content is too high, the hot workability of the steel will decrease. In addition, if the Mn content is too high, the hardenability will increase and bainite will form in the structure of the steel. This results in a decrease in the fracture splittability of the steel. Accordingly, the Mn content ranges from 0.50 to 1.00%. The lower limit of the Mn content is preferably more than 0.50%, more preferably 0.60%, and even more preferably 0.65%. The upper limit of the Mn content is preferably less than 1.00%, more preferably 0.95%, and even more preferably 0.90%.

P: 0.04 to 0.07%

Phosphorus (P) segregates at the grain boundaries and embrittles the steel. As a result, the fracture surfaces of the fracture splitting connecting rod after being fractured and split are smooth. This results in increased accuracy in assembling the fracture splitting connecting rod after being fractured and split. If the P content is too low, this advantageous effect cannot be produced. On the other hand, if the P content is too high, the hot workability of the steel will decrease. Accordingly, the P content ranges from 0.04 to 0.07%. The lower limit of the P content is preferably more than 0.04%, more preferably 0.042%, and even more preferably 0.045%. The upper limit of the P content is preferably less than 0.07%, more preferably 0.068%, and even more preferably 0.065%.

S: 0.04 to 0.13%

Sulfur (S) combines with Mn and Ti to form sulfides and thereby increases the machinability of the steel. If the S content is too low, this advantageous effect cannot be produced. On the other hand, if the S content is too high, the hot workability of the steel will decrease. Accordingly, the S content ranges from 0.04 to 0.13%. The lower limit of the S content is preferably more than 0.04%, more preferably 0.045%, and even more preferably 0.05%. The upper limit of the S content is preferably less than 0.13%, more preferably 0.125%, and even more preferably 0.12%.

Cr: 0.10 to 0.30%

Chromium (Cr) increases the strength of the steel. If the Cr content is too low, this advantageous effect cannot be produced. On the other hand, if the Cr content is too high, the hardenability of the steel will increase and bainite will form in the structure of the steel. This results in a decrease in the fracture splittability of the steel. In addition, if the Cr content is too high, the production cost will increase. Accordingly, the Cr content ranges from 0.10 to 0.30%. The lower limit of the Cr content is preferably more than 0.10%, more preferably 0.11%, and even more preferably 0.12%. The upper limit of the Cr content is preferably less than 0.30%, more preferably 0.25%, and even more preferably 0.20%.

V: 0.05 to 0.14%

Vanadium (V) precipitates in the ferrite as carbides in the cooling process after hot forging and thereby increases the yield strength of the steel. In addition, V, when included together with Ti, increases the fracture splittability of the steel. If the V content is too low, these advantageous effects cannot be produced. On the other hand, if the V content is too high, the cost of producing the steel will extremely increase, and in addition, the machinability will decrease. Accordingly, the V content ranges from 0.05 to 0.14%. The lower limit of the V content is preferably more than 0.05%, more preferably 0.06%, and even more preferably 0.07%. The upper limit of the V content is preferably less than 0.14%, more preferably 0.13%, and even more preferably less than 0.13%.

Ti: more than 0.15% to 0.20% or less

Titanium (Ti) precipitates as carbides or nitrides in the steel and thereby increases the strength of the steel. In addition, Ti forms sulfides or carbo-sulfides and thereby increases the machinability of the steel.

When the rolled steel material for fracture splitting connecting rods is heated prior to hot forging, part of Ti in the Ti sulfides and Ti carbo-sulfides dissolves. Furthermore, when the steel material is allowed to cool in air after hot forging, the part of Ti remains dissolved until the ferrite transformation begins. When the ferrite transformation has begun, the dissolved Ti precipitates together with V in the ferrite as carbides and thereby increases the yield strength and tensile strength of the steel. In addition, the Ti carbides, which formed during the ferrite transformation, embrittles the ferrite to increase the fracture splittability of the steel. If the Ti content is too low, these advantageous effects cannot be produced. On the other hand, if the Ti content is too high, excessive amounts of Ti will dissolve prior to hot forging. In such a case, the hardenability of the steel will increase and bainite will form therein. Furthermore, an excessively large number of Ti carbides will precipitate, which will result in an excessively high tensile strength. This results in a decrease in the machinability of the steel. Accordingly, the Ti content ranges from more than 0.15% to 0.20% or less. The upper limit of the Ti content is preferably less than 0.20%, and more preferably 0.19%.

N: 0.002 to 0.020%

Nitrogen (N) combines with Ti to form nitrides and thereby increases the strength of the steel. If the N content is too low, this advantageous effect cannot be produced. On the other hand, if the N content is too high, this advantageous effect reaches saturation. Accordingly, the N content ranges from 0.002 to 0.020%. The lower limit of the N content is preferably more than 0.002%, more preferably 0.003%, and even more preferably 0.004%. The upper limit of the N content is preferably less than 0.020%, more preferably 0.019%, and even more preferably 0.018%.

The balance of the chemical composition of the rolled steel material for fracture splitting connecting rods according to the present embodiment is made up of Fe and impurities. Herein, the impurities refers to impurities that are incidentally included in the steel material, during its industrial production, from raw materials such as ores and scrap or from the production environment for example, and which are allowable within a range that does not adversely affect the steel material of the present embodiment.

The chemical composition of the rolled steel material for fracture splitting connecting rods according to the present embodiment may further contain, as a partial replacement for Fe, one or more selected from the group consisting of Cu, Ni, and Mo. These elements are optional elements and each increase the strength of the steel.

Cu: 0 to 0.40%

Copper (Cu) is an optional element and may not be contained. When contained, Cu dissolves in the steel and thereby increases the strength of the steel. However, if the Cu content is too high, the cost of producing the steel will increase, and in addition, the machinability will decrease. Accordingly, the Cu content ranges from 0 to 0.40%. The lower limit of the Cu content is preferably 0.01%, more preferably 0.05%, and even more preferably 0.10%. The upper limit of the Cu content is preferably less than 0.40%, more preferably 0.35%, and even more preferably 0.30%.

Ni: 0 to 0.30%

Nickel (Ni) is an optional element and may not be contained. When contained, Ni dissolves in the steel and thereby increases the strength of the steel. However, if the Ni content is too high, the production cost will increase, and in addition, the Charpy impact value will increase and thus the fracture splittability will decrease. Accordingly, the Ni content ranges from 0 to 0.30%. The lower limit of the Ni content is preferably 0.01%, more preferably 0.02%, and even more preferably 0.05%. The upper limit of the Ni content is preferably less than 0.30%, more preferably 0.28%, and even more preferably 0.25%.

Mo: 0 to 0.10%

Molybdenum (Mo) is an optional element and may not be contained. When contained, Mo dissolves in the steel and thereby increases the strength of the steel. In addition, Mo forms carbides in the steel and thereby increases the strength of the steel. However, if the Mo content is too high, the hardenability will increase and bainite will form after hot forging. This results in a decrease in the fracture splittability of the steel. Accordingly, the Mo content ranges from 0 to 0.10%. The lower limit of the Mo content is preferably 0.01%. The upper limit of the Mo content is preferably less than 0.10%, more preferably 0.09%, and even more preferably 0.08%.

The chemical composition of the rolled steel material for fracture splitting connecting rods according to the present embodiment may further contain, as a partial replacement for Fe, one or more selected from the group consisting of Pb, Te, Ca, and Bi. These elements are optional elements and each increase the machinability of the steel.

Pb: 0 to 0.30%

Lead (Pb) is an optional element and may not be contained. When contained, Pb increases the machinability of the steel. However, if the Pb content is too high, the hot workability of the steel will decrease. Accordingly, the Pb content ranges from 0 to 0.30%. The lower limit of the Pb content is preferably 0.05%, and more preferably 0.10%. The upper limit of the Pb content is preferably less than 0.30%, more preferably 0.25%, and even more preferably 0.20%.

Te: 0 to 0.30%

Tellurium (Te) is an optional element and may not be contained. When contained, Te increases the machinability of the steel. However, if the Te content is too high, the hot workability of the steel will decrease. Accordingly, the Te content ranges from 0 to 0.30%. The lower limit of the Te content is preferably 0.0003%, more preferably 0.0005%, and even more preferably 0.0010%. The upper limit of the Te content is preferably less than 0.30%, more preferably 0.25%, and even more preferably 0.20%.

Ca: 0 to 0.010%

Calcium (Ca) is an optional element and may not be contained. When contained, Ca increases the machinability of the steel. However, if the Ca content is too high, the hot workability of the steel will decrease. Accordingly, the Ca content ranges from 0 to 0.010%. The lower limit of the Ca content is preferably 0.0003%, more preferably 0.0005%, and even more preferably 0.0010%. The upper limit of the Ca content is preferably less than 0.010%, more preferably 0.008%, and even more preferably 0.005%.

Bi: 0 to 0.30%

Bismuth (Bi) is an optional element and may not be contained. When contained, Bi increases the machinability of the steel. However, if the Bi content is too high, the hot workability of the steel will decrease. Accordingly, the Bi content ranges from 0 to 0.30%. The lower limit of the Bi content is preferably 0.0003%, more preferably 0.0005%, and even more preferably 0.0010%. The upper limit of the Bi content is preferably less than 0.30%, more preferably 0.20%, and even more preferably 0.10%.

[Formula (1)]

Furthermore, in the chemical composition of the steel material of the present embodiment, fn1, which is defined by Formula (1), ranges from 0.65 to 0.80.

$$fn1 = C + Si/10 + Mn/5 + 5Cr/22 + (Cu+Ni)/20 + Mo/2 + 33V/20 - 5S/7 \quad (1)$$

The element symbols in Formula (1) are each substituted by the content (mass %) of the corresponding element. In the case where the element corresponding to the element symbol in Formula (1) is not present, the element symbol is substituted by "0".

There is a positive correlation between fn1 and the tensile strength of the steel after being hot forged. If fn1 is more than 0.80, the steel will have excessively high tensile strength and therefore decreased machinability. Furthermore, there is also a positive correlation between fn1 and the yield strength of the steel. Thus, if fn1 is less than 0.65, the steel will have decreased strength. When fn1 is 0.65 to 0.80, the steel exhibits excellent strength and machinability. The lower limit of fn1 is preferably more than 0.65, more preferably 0.66, and even more preferably 0.67. The upper limit of fn1 is preferably less than 0.80, more preferably 0.79, and even more preferably 0.78.

[V Content and Ti content in Precipitates]

Furthermore, according to the present embodiment, relative to the V content in the rolled steel material for fracture splitting connecting rods, a V content in coarse precipitates having a particle size of 200 nm or more is 70% or less. Furthermore, relative to the Ti content in the rolled steel material for fracture splitting connecting rods, a Ti content in the coarse precipitates is 50% or more. This will be described in detail below.

[V Content in Precipitates]

In the present embodiment, V precipitates as carbides. More specifically, V dissolves in the heating step prior to hot forging, and then, during cooling after hot forging, it precipitates as carbides at the austenite-ferrite interphase boundaries under phase transformation (interphase boundary precipitation). The interphase boundary precipitation of V carbides results in increased yield strength of the hot forged steel material. In order to produce this effect, it is preferred that V dissolve in the austenite in the steel material prior to hot forging.

An effective way to promote the dissolution of V-containing precipitates (hereinafter referred to as V precipitates) is to refine the V precipitates prior to hot forging to increase the total surface area of the V precipitates. That is, fineness of the V precipitates in the rolled steel material for fracture splitting connecting rods assists in dissolution of V. This is because, when the V precipitates are fine and have a large total surface area, sufficient amounts of V dissolve in the austenite during heating, even if the heating temperature for hot forging is low (e.g., 1000° C.).

The V content in the entire rolled steel material for fracture splitting connecting rods is denoted as Vm (mass %) and the V content in coarse precipitates in the entire steel material is denoted as Vp (mass %). Here, when a V fraction Rv, which is defined by Formula (2), is not more than 70%, V precipitates in the rolled steel material for fracture splitting connecting rods are sufficiently fine. As a result, sufficient amounts of V dissolve during heating for hot forging. As a result, fine V carbides precipitate in the cooling process after hot forging, which results in high strength of the hot forged steel material.

$$Rv=Vp/Vm\times 100 \quad (2)$$

Vm and Vp are measured in the following manner. A cylindrical specimen of 8 mm diameter and 12 mm length is obtained from any one of R/2 regions of the rolled steel material for fracture splitting connecting rods in round bar form (R/2 region refers to a region, in the cross section of the steel material, including a point that bisects the length between the central axis of the steel material and the outer peripheral surface of the steel material). The length of the cylindrical specimen is parallel to the axial direction of the steel material.

Using the cylindrical specimen, extraction residue analysis by an electrolytic process is carried out. Specifically, the outer layer of the cylindrical specimen is removed from the surface to a depth of 200 μm by adjusting the electrolysis time while maintaining a constant current. This removes impurities that have deposited on the surface of the cylindrical specimen. After the surface layer has been removed, the electrolyte solution is replaced with a new electrolyte solution. Both electrolyte solutions are AA type electrolyte solutions (electrolyte solutions containing 10 vol % acetyl acetone and 1 vol % tetramethylammonium chloride with the balance being methanol).

Using the new electrolyte solution, electrolysis is performed on the cylindrical specimen. In the electrolysis, while the current is maintained constant at 1000 mA, the electrolysis time is adjusted so that the cylindrical specimen, subjected to the electrolysis, has a volume of 0.5 $cm^3$. The electrolyte solution after the electrolysis is filtered through a filter having a mesh size of 200 nm to obtain the residue. The obtained residue corresponds to the coarse precipitates.

Inductively coupled plasma (ICP) emission spectroscopy is performed on the obtained residue to determine Vp (%), the V content in the coarse precipitates. Specifically, Vp is determined by the following formula.

$$Vp=V \text{ content (mg) in coarse precipitates in 0.5 cm}^3 \text{ steel material/mass (mg) of 0.5 cm}^3 \text{ steel material}\times 100$$

The V content in the rolled steel material for fracture splitting connecting rods is measured in the following manner using the cylindrical specimen after being subjected to the electrolysis. Machined chips are obtained from the cylindrical specimen. The machined chips can be obtained by machining the cylindrical specimen with a lathe, for example. ICP emission spectroscopy is performed on the machined chips to determine the V content Vm (%). Using the determined Vp and Vm, the V fraction Rv (%) is determined by Formula (2).

[Ti Content in Precipitates]

In the present embodiment, Ti precipitates as Ti carbides or Ti nitrides and Ti sulfides or Ti carbo-sulfides. Ti sulfides and Ti carbo-sulfides increase the fracture splittability of the steel material. However, if excessive amounts of Ti sulfides and Ti carbo-sulfides dissolve during heating for hot forging, the amount of Ti dissolved in the austenite increases, and this is not preferred. If the heating temperature for hot forging is high (e.g., 1280° C.) and excessive amounts of Ti dissolve in the austenite, Ti carbides precipitate in excessive amounts in the cooling process after hot forging. This results in excessively high strength of the hot forged steel material and therefore a decrease in the machinability thereof.

Furthermore, if the amount of dissolved Ti in the austenite is excessive, bainite will form during cooling. Bainite increases the Charpy impact value of the steel material excessively. This results in a decrease in the fracture splittability of the steel material.

Thus, it is preferred that Ti sulfides and Ti carbo-sulfides do not dissolve in large amounts during heating for hot forging. An effective way to inhibit an excessive dissolution of Ti is to coarsen Ti-containing precipitates (hereinafter referred to as Ti precipitates) prior to hot forging to reduce the surface area of the Ti precipitates. This is because, when Ti precipitates are coarse and their total surface area is small, Ti does not readily dissolve in the austenite during heating even if the heating temperature for hot forging is high (e.g., 1280° C.).

The Ti content in the rolled steel material for fracture splitting connecting rods is denoted as Tim (%) and the Ti content in the coarse precipitates is denoted as Tip (%). Here, when a Ti fraction Rti, which is defined by Formula (3), is not less than 50%, the Ti precipitates in the rolled steel material for fracture splitting connecting rods are sufficiently coarse. As a result, an excessive dissolution of Ti during heating for hot forging can be sufficiently inhibited. As a result, the hot forged steel material exhibits high machinability and fracture splittability.

$$Rti=Tip/Tim\times 100 \quad (3)$$

Tim and Tip are measured in the following manner. A cylindrical specimen is obtained in the same manner as that for the case of determining Vm and Vp. Then, electrolysis is performed under the same conditions as those for the case of determining Vm and Vp to thereby obtain the residue (coarse precipitates). 1CP emission spectroscopy is performed on the residue under the same conditions as those for the case of determining Vp to determine Tip (%), the Ti content in the coarse precipitates. Specifically, Tip is determined by the following formula.

$Tip$=Ti content (mg) in coarse precipitates in 0.5 $cm^3$ steel material/mass (mg) of 0.5 $cm^3$ steel material×100

Furthermore, machined chips are obtained in the same manner as that for the case of determining Vm. 1CP emission spectroscopy is performed on the obtained machined chips under the same conditions as those for the case of determining Vm to determine Tim (%), the Ti content in the steel material. The Ti fraction Rti (%) is determined by Formula (3) using the determined Tip and Tim.

The Ti fraction Rti is preferably more than 50%, more preferably not less than 60%, and even more preferably not less than 70%.

[Production Method]

Described below is an exemplary method for producing the above-described rolled steel material for fracture splitting connecting rods.

A molten steel having the chemical composition mentioned above is produced by a well-known method. The produced molten steel is subjected to continuous casting to produce a continuously cast material (slab or bloom). The molten steel may be subjected to an ingot-making process to produce an ingot. A billet may be produced by continuous casting.

The produced continuously cast material or ingot is subjected to hot working to produce a billet. The hot working is, for example, hot rolling. The hot rolling is carried out using, for example, a billeting machine and a continuous rolling mill in which a plurality of stands are arranged in a line.

A steel bar (rolled steel material for fracture splitting connecting rods) is produced from the billet. Specifically, the billet is heated in a reheating furnace (heating step). After being heated, the billet is hot rolled using a continuous mill to be formed into a rolled steel material for fracture splitting connecting rods in bar form (hot rolling step). These steps will be described below.

[Heating Step]

In the heating step, the billet is heated to 1000 to 1100° C. If the heating temperature, Tf, is too low, V precipitates in the billet do not readily dissolve. As a result, coarse V precipitates that were present in the billet are retained even after hot rolling, resulting in large amounts of coarse V precipitates in the hot rolled steel material. As a result, the V fraction Rv will exceed 70%. Furthermore, if the heating temperature Tf is too low, Ti precipitates do not agglomerate and grow during heating and therefore do not readily become coarse. As a result, in the rolled steel material, coarse Ti precipitates will be present in small amounts, and therefore the Ti fraction Rti will fall below 50%.

When the heating temperature Tf is increased, Ti precipitates agglomerate and grow. However, if the heating temperature Tf is excessively high, excessive amounts of Ti precipitates will dissolve during heating. The dissolved Ti finely precipitates as carbides during rolling or during cooling. As a result, the Ti fraction Rti will fall below 50%.

When the heating temperature Tf ranges from 1000 to 1100° C., V precipitates dissolve suitably and the Ti precipitates agglomerate and grow during heating to become coarse. When the below-described conditions for hot rolling step are also satisfied, the rolled steel material for fracture splitting connecting rods, after being rolled, have the V fraction Rv of not more than 70% and the Ti fraction Rti of not less than 50%.

[Hot Rolling Step]

The heated billet is hot rolled using a continuous mill to produce the rolled steel material for fracture splitting connecting rods.

The continuous mill includes a plurality of sets of rolls. Each set of rolls includes a pair of rolls or three or more rolls disposed around the rolling axis (pass line). The rolling axis means a line along which the billet to be rolled is passed. The plurality of sets of rolls are arranged in a line. Each set of rolls is accommodated in a corresponding stand.

In the hot rolling step, the rolling rate, Vr, ranges from 5 to 20 m/second. The rolling rate Vr is defined as follows. A time t0 (second) is measured, which is a length of time from when the leading end of the billet is rolled by the first set of rolls, among the plurality of sets of rolls of the continuous mill, to when it is rolled by the last set of rolls among the sets to be used for the rolling. The time t0 can be measured by finding the load applied to the first rolls and the load applied to the last rolls. The rolling rate Vr (m/second) is determined by Formula (4) using the time t0.

$Vr$=distance along the rolling axis from the center of the first set of rolls to the center of the last set of rolls/$t0$ (4).

In short, the rolling rate Vr means a rolling rate throughout the hot rolling. If the rolling rate Vr is too slow, work-induced heat due to hot rolling is less likely to occur. As a result, during the rolling, the temperature of the workpiece decreases. In such a case, Ti precipitates do not readily agglomerate and grow during the rolling. Consequently, the Ti fraction Rti will fall below 50%.

On the other hand, if the rolling rate Vr is too fast, excessive work-induced heat is more likely to occur in the workpiece being rolled. In such a case, V carbides that precipitate during rolling will be coarser. As a result, large amounts of coarse V precipitates will form. Consequently, the V fraction Rv will exceed 70%.

Furthermore, water cooling is performed for 1 to 3 seconds on the workpiece being rolled at a reduction of area of 50 to 70%. The reduction of area is defined as follows. A cross-sectional area A0 ($mm^2$) of the starting material, i.e., the billet, for the hot rolling process (the area of the cross section perpendicular to the central axis of the billet) is determined. Next, a cross-sectional area A1 ($mm^2$) of the workpiece after having been passed through a selected one of the sets of rolls in the continuous mill is determined. The cross-sectional area A1 can be calculated from the groove of the selected one of the sets of rolls. Alternatively, the cross-sectional area A1 may be determined by actually rolling the workpiece through the selected one of the sets of rolls.

The reduction of area (%) is determined by Formula (5) using A0 and A1.

$$\text{Reduction of area}=(A0-A1)/A0\times 100 \quad (5)$$

Water cooling is performed for 1 to 3 seconds on the workpiece being rolled, at a location where the reduction of area reaches 50 to 70%. For example, water cooling equipment (water cooling zone) is provided between sets of rolls (between stands) where the reduction of area reaches 50 to 70%. The workpiece is water cooled when it is being passed through the water cooling equipment. The amount of water for the water cooling is 100 to 300 liters/second.

If the water cooling time, tw, is too short, the temperature of the workpiece will become excessively high because of work-induced heat. In such a case, V carbides that precipitate during rolling will be coarser. As a result, large amounts of coarse V precipitates will form. Consequently, the V fraction Rv will exceed 70%.

On the other hand, if the water cooling time tw is too long, the temperature of the workpiece will become excessively low. In such a case, Ti precipitates do not agglomerate and grow during the rolling and therefore not readily become coarse. Consequently, the Ti fraction Rti will fall below 50%.

When the heating temperature Tf, rolling rate Vr, and water cooling time tw fall within the ranges described above, the steel material after being rolled has the V fraction Rv of not more than 70% and the Ti fraction Rti of not less than 50%.

[Connecting Rod Production Step]

Described below is an exemplary method for producing a fracture splitting connecting rod from the rolled steel material for fracture splitting connecting rods. Firstly, the steel material is heated in a reheating furnace. The heated steel material is subjected to hot forging to produce a fracture splitting connecting rod. Preferably, the degree of deformation in the hot forging is not less than 0.22. Herein, the degree of deformation is the value of the maximum logarithmic strain that occurs in the material excluding flash in the forging process.

The hot forged fracture splitting connecting rod is allowed to cool to room temperature. The fracture splitting connecting rod after cooling is subjected, as necessary, to machining. Through the steps described above, the fracture splitting connecting rod is produced.

When the rolled steel material for fracture splitting connecting rods of the present embodiment is employed, the resulting fracture splitting connecting rod exhibits excellent fracture splittability, excellent machinability, and excellent yield strength as long as the heating temperature for hot forging is within the range of 1000 to 1280° C.

EXAMPLES

A molten steel having the chemical composition shown in Table 1 was produced.

TABLE 1

| | Chemical composition (in mass %, the balance being Fe and impurities) | | | | | | | | | | | | | | | | |
|---|---|---|---|---|---|---|---|---|---|---|---|---|---|---|---|---|---|
| Steel | C | Si | Mn | P | S | Cr | V | Ti | N | Cu | Ni | Mo | Pb | Te | Ca | Bi | fn1 |
| A | 0.31 | 0.65 | 0.73 | 0.05 | 0.096 | 0.15 | 0.108 | 0.170 | 0.005 | — | — | — | — | — | — | — | 0.66 |
| B | 0.38 | 0.61 | 0.62 | 0.05 | 0.118 | 0.17 | 0.108 | 0.166 | 0.003 | — | — | — | — | — | — | — | 0.70 |
| C | 0.32 | 0.71 | 0.86 | 0.05 | 0.090 | 0.17 | 0.118 | 0.155 | 0.006 | — | — | — | — | — | — | — | 0.73 |
| D | 0.34 | 0.95 | 0.83 | 0.07 | 0.098 | 0.14 | 0.074 | 0.175 | 0.012 | — | — | — | — | — | — | — | 0.68 |
| E | 0.38 | 0.78 | 0.84 | 0.05 | 0.088 | 0.11 | 0.128 | 0.168 | 0.013 | — | — | — | — | — | — | — | 0.80 |
| F | 0.36 | 0.61 | 0.74 | 0.05 | 0.101 | 0.20 | 0.098 | 0.190 | 0.009 | — | — | — | — | — | — | — | 0.70 |
| G | 0.36 | 0.60 | 0.75 | 0.05 | 0.095 | 0.19 | 0.100 | 0.188 | 0.008 | — | — | — | 0.21 | — | — | — | 0.71 |
| H | 0.37 | 0.61 | 0.76 | 0.05 | 0.098 | 0.18 | 0.099 | 0.189 | 0.006 | — | — | — | — | 0.23 | — | — | 0.72 |
| I | 0.37 | 0.61 | 0.75 | 0.05 | 0.092 | 0.18 | 0.098 | 0.192 | 0.008 | — | — | — | — | — | 0.003 | 0.02 | 0.72 |
| J | 0.37 | 0.61 | 0.62 | 0.05 | 0.118 | 0.17 | 0.108 | 0.158 | 0.003 | 0.20 | 0.10 | 0.03 | — | — | — | — | 0.72 |
| K | 0.31 | 0.71 | 0.86 | 0.05 | 0.090 | 0.17 | 0.118 | 0.165 | 0.006 | 0.29 | 0.20 | 0.06 | — | — | — | — | 0.78 |
| L | 0.34 | 0.95 | 0.83 | 0.07 | 0.098 | 0.14 | 0.074 | 0.185 | 0.012 | 0.10 | 0.08 | 0.10 | — | — | — | — | 0.74 |
| M | 0.32 | 0.78 | 0.84 | 0.05 | 0.088 | 0.11 | 0.128 | 0.168 | 0.013 | 0.38 | 0.28 | 0.02 | — | — | — | — | 0.78 |
| N | 0.36 | 0.65 | 0.74 | 0.05 | 0.101 | 0.20 | 0.098 | 0.175 | 0.009 | 0.25 | 0.15 | 0.06 | — | — | — | — | 0.76 |
| O | 0.35 | 0.63 | 0.75 | 0.05 | 0.103 | 0.19 | 0.100 | 0.178 | 0.011 | 0.24 | 0.16 | 0.05 | 0.20 | — | — | — | 0.74 |
| P | 0.35 | 0.63 | 0.75 | 0.05 | 0.105 | 0.20 | 0.101 | 0.177 | 0.010 | 0.25 | 0.16 | 0.05 | — | 0.23 | — | — | 0.75 |
| Q | 0.36 | 0.64 | 0.74 | 0.05 | 0.101 | 0.19 | 0.100 | 0.177 | 0.010 | 0.25 | 0.15 | 0.06 | — | — | 0.004 | 0.02 | 0.76 |
| R | 0.39 | 0.73 | 0.86 | 0.05 | 0.086 | 0.15 | *0.045 | 0.170 | 0.004 | — | — | — | — | — | — | — | 0.68 |
| S | 0.31 | 0.67 | 0.58 | 0.07 | 0.114 | 0.12 | 0.112 | 0.152 | 0.003 | — | — | — | — | — | — | — | *0.62 |
| T | 0.37 | 0.88 | 0.88 | 0.07 | 0.109 | 0.18 | 0.128 | 0.163 | 0.004 | — | — | — | — | — | — | — | *0.81 |
| U | 0.33 | 0.69 | 0.78 | 0.06 | 0.102 | 0.15 | 0.103 | *0.138 | 0.003 | — | — | — | — | — | — | — | 0.69 |
| V | 0.34 | 0.72 | 0.65 | 0.05 | 0.099 | 0.14 | 0.072 | 0.198 | 0.002 | 0.10 | 0.08 | 0.02 | — | — | — | — | *0.64 |
| W | 0.38 | 0.78 | 0.72 | 0.06 | 0.110 | 0.17 | 0.119 | 0.170 | 0.004 | 0.25 | 0.15 | 0.06 | — | — | — | — | *0.81 |
| X | *0.41 | 0.64 | 0.78 | 0.05 | 0.092 | 0.22 | 0.092 | 0.158 | 0.006 | 0.20 | 0.09 | 0.04 | — | — | — | — | 0.80 |
| Y | 0.38 | 0.62 | 0.72 | 0.07 | 0.088 | 0.13 | 0.096 | *0.132 | 0.003 | 0.29 | 0.20 | 0.06 | — | — | — | — | 0.77 |
| Z | 0.35 | 0.88 | 0.76 | 0.06 | 0.102 | 0.13 | *0.045 | 0.174 | 0.014 | 0.04 | 0.06 | 0.10 | — | — | — | — | 0.68 |
| AA | 0.32 | 0.74 | 0.74 | 0.07 | 0.116 | 0.18 | 0.066 | 0.163 | 0.012 | 0.25 | 0.20 | *0.19 | — | — | — | — | 0.73 |
| AB | *0.70 | *0.20 | 0.53 | *0.01 | 0.060 | 0.12 | *0.029 | *— | 0.015 | 0.09 | 0.06 | — | — | — | — | — | *0.87 |

1) Symbol "*" indicates that the value falls outside the range specified by the present embodiment.

With reference to Table 1, Steels A to Q each had an appropriate chemical composition and their fn1s, defined by Formula (1), were within the range of 0.65 to 0.80. On the other hand, as for Steels R to AB, either an element content in the chemical composition or fn1 was inappropriate. The chemical composition of Steel AB was within the range of the chemical composition of the steel disclosed in Patent Literature 1.

Steels A and B were produced in a 70 ton converter and Steels C to AB were produced in a 3 ton laboratory furnace. A bloom or an ingot was produced from the produced molten steels. The produced bloom or ingot was subjected to billeting to produce billets. The temperature to which the steel material was heated for billeting was 1100° C. The cross section of the billet (cross section perpendicular to the axial direction of the billet) had a rectangular shape of 180 mm×180 mm. The steel grade of the billet used in each number of test was as shown in the "starting material" column in Table 2.

The billets were subjected to hot rolling using a continuous mill to produce rolled steel materials for fracture splitting connecting rods of Test Nos. 1 to 42. For the production, the heating temperatures Tf, rolling rates Vr, and water cooling times tw were as shown in Table 2. Water cooling was applied to the workpiece (billet) when the reduction of area reached 65%. The amount of water was 200 liters/second.

TABLE 2

| Test No. | Starting material | Heating temperature Tf | Rolling rate Vr | Water cooling time tw | Rv | Rti |
|---|---|---|---|---|---|---|
| 1 | Steel A | 1000° C. | 10 m/s | 2 s | 63% | 97% |
| 2 | Steel B | 1000° C. | 10 m/s | 2 s | 68% | 92% |
| 3 | Steel C | 1000° C. | 10 m/s | 2 s | 64% | 98% |
| 4 | Steel D | 1000° C. | 10 m/s | 2 s | 59% | 98% |
| 5 | Steel E | 1000° C. | 10 m/s | 2 s | 52% | 82% |
| 6 | Steel F | 1000° C. | 10 m/s | 2 s | 63% | 99% |
| 7 | Steel G | 1000° C. | 10 m/s | 2 s | 61% | 93% |
| 8 | Steel H | 1000° C. | 10 m/s | 2 s | 68% | 91% |
| 9 | Steel I | 1000° C. | 10 m/s | 2 s | 56% | 88% |
| 10 | Steel J | 1000° C. | 10 m/s | 2 s | 58% | 81% |
| 11 | Steel K | 1000° C. | 10 m/s | 2 s | 69% | 90% |
| 12 | Steel L | 1000° C. | 10 m/s | 2 s | 48% | 82% |
| 13 | Steel M | 1000° C. | 10 m/s | 2 s | 67% | 85% |
| 14 | Steel N | 1000° C. | 10 m/s | 2 s | 61% | 98% |
| 15 | Steel O | 1000° C. | 10 m/s | 2 s | 66% | 92% |
| 16 | Steel P | 1000° C. | 10 m/s | 2 s | 66% | 94% |
| 17 | Steel Q | 1000° C. | 10 m/s | 2 s | 65% | 92% |
| 18 | Steel A | 1100° C. | 10 m/s | 2 s | 69% | 99% |
| 19 | Steel B | 1100° C. | 10 m/s | 2 s | 69% | 97% |
| 20 | #Steel R | 1000° C. | 10 m/s | 2 s | 66% | 97% |
| 21 | #Steel S | 1000° C. | 10 m/s | 2 s | 64% | 94% |
| 22 | #Steel T | 1000° C. | 10 m/s | 2 s | 66% | 88% |
| 23 | #Steel U | 1000° C. | 10 m/s | 2 s | 56% | 83% |
| 24 | #Steel V | 1000° C. | 10 m/s | 2 s | 63% | 88% |
| 25 | #Steel W | 1000° C. | 10 m/s | 2 s | 62% | 86% |
| 26 | #Steel X | 1000° C. | 10 m/s | 2 s | 66% | 84% |
| 27 | #Steel Y | 1000° C. | 10 m/s | 2 s | 61% | 91% |
| 28 | #Steel Z | 1000° C. | 10 m/s | 2 s | 55% | 89% |
| 29 | #Steel AA | 1000° C. | 10 m/s | 2 s | 67% | 95% |
| 30 | Steel A | 900° C. | 10 m/s | 2 s | *84% | *48% |
| 31 | Steel A | 1000° C. | 10 m/s | 0.5 s | *82% | 97% |
| 32 | Steel A | 1000° C. | 10 m/s | 5 s | 64% | *47% |
| 33 | Steel A | 1000° C. | 3 m/s | 2 s | 62% | *44% |
| 34 | Steel A | 1000° C. | 25 m/s | 2 s | *78% | 82% |
| 35 | Steel A | 1200° C. | 10 m/s | 2 s | 62% | *42% |
| 36 | Steel B | 900° C. | 10 m/s | 2 s | *78% | *46% |
| 37 | Steel B | 1000° C. | 10 m/s | 0.5 s | *86% | 96% |
| 38 | Steel B | 1000° C. | 10 m/s | 5 s | 68% | *48% |
| 39 | Steel B | 1000° C. | 3 m/s | 2 s | 65% | *46% |
| 40 | Steel B | 1000° C. | 25 m/s | 2 s | *82% | 84% |
| 41 | Steel B | 1200° C. | 10 m/s | 2 s | 67% | *39% |
| 42 | #Steel AB | 1000° C. | 10 m/s | 2 s | — | — |

1) Symbol "#" indicates that the chemical composition falls outside the range specified by the present embodiment.
2) Symbol "*" indicates that the value falls outside the range specified by the present embodiment.

The rolled steel materials for fracture splitting connecting rods of all test numbers were round bars having a diameter of 35 mm.

[Experiment for Measuring V Fraction Rv and Ti Fraction Rti]

Using the measurement methods described above, Vm (%), Vp (%), Tim (%), and Tip (%) of each test number were determined. Furthermore, the V fraction Rv and the Ti fraction Rti were determined using Formula (2) and Formula (3). The determined V fractions Rv and Ti fractions Rti are shown in Table 2.

[Production of Simulated Forged Product]

From the round bars of Test Nos. 1 to 41, small round bar specimens and large round bar specimens were obtained. The small round bar specimens were 22 mm in diameter and 50 mm in length. The central axis of each small round bar specimen conformed to the central axis of the round bar, which had a diameter of 35 mm, of the corresponding test number. The large round bar specimens were 32 mm in diameter and 50 mm in length. The central axis of each large round bar specimen conformed to the central axis of the round bar, which had a diameter of 35 mm, of the corresponding test number.

Each small round bar specimen was heated and held at 1000° C. for 5 minutes. Thereafter, it was subjected to forward extrusion to produce a round bar having a diameter of 20 mm. The extruded round bar was allowed to cool in air. The reduction of area in the forward extrusion was 20%. Hereinafter, the round bar produced from a small round bar specimen is referred to as "low temperature simulated forged product".

Each large round bar specimen was heated and held at 1280° C. for 5 minutes. Thereafter, it was subjected to forward extrusion to produce a round bar having a diameter of 20 mm. The extruded round bar was allowed to cool in air. The reduction of area in the forward extrusion was 60%. Hereinafter, the round bar produced from a large round bar specimen is referred to as "high temperature simulated forged product".

[Production of Reference Forged Product]

From the round bar of Test No. 42, a plurality of large round bar specimens were obtained. The large round bar specimens were heated and held at 1250° C. for 5 minutes. Thereafter, they were subjected to forward extrusion to produce round bars having a diameter of 20 mm. Hereinafter, the simulated forged products of Test No. 42 are referred to as "reference product".

[Microstructure Observation Experiment]

A microstructure observation experiment was conducted using the low temperature simulated forged products, high temperature simulated forged products, and reference products of the respective test numbers. Specifically, samples were obtained from the forged products (low temperature simulated forged products, high temperature simulated forged products, and reference products) so that each sample included an R/2 region in the cross section of the forged product. A surface of each sample (hereinafter referred to as observation surface) was polished and etched with a nital etching reagent, the surface corresponding to the cross section including an R/2 region. After etching, the microstructure of the observation surface was observed with an optical microscope at a magnification of 400×.

[Fracture Splittability Evaluation Test]

A Charpy impact test was conducted on each forged product to evaluate the fracture splittability. Specifically, a V-notch test specimen (No. 4 test specimen) specified in JIS Z 2202 (2012) was obtained from a central portion of each forged product. Using the test specimens, a Charpy impact test was conducted in air at room temperature (25° C.) to determine the impact value (J/cm$^2$). Impact values of not more than 10 J/cm$^2$ were evaluated as excellent fracture splittability.

[Yield Strength and Tensile Strength Evaluation Test]

A JIS No. 14A test specimen was obtained from an R/2 region of each forged product. Using the obtained test specimens, a tensile test was conducted in air at room temperature (25° C.) to determine the yield strength YS (MPa) and tensile strength TS (MPa).

With regard to the yield strengths YS (MPa) of Test Nos. 1 to 41, the relative values Rys thereof (in %, hereinafter referred to as relative yield strength) to the yield strength YS (MPa) of the reference product were determined. Furthermore, with regard to the tensile strengths TS (MPa) of Test Nos. 1 to 41, the relative values Rts thereof (in %, hereinafter referred to as relative tensile strength) to the tensile strength TS (MPa) of the reference product were determined.

Relative yield strengths Rys of not less than 110% were evaluated as excellent yield strength. Furthermore, relative tensile strengths Rts of not more than 100% were evaluated as excellent machinability.

[Test Results]

The test results are shown in Table 3. In Table 3, "F" in the "microstructure" column means ferrite was observed. "P" means pearlite was observed. "B" means bainite was observed.

With reference to Table 3, in Test Nos. 1 to 19, the chemical compositions were appropriate and the fn1 values were appropriate. Furthermore, the V fractions Rv and Ti fractions Rti were appropriate. Furthermore, the microstructures were made up of ferrite and pearlite with no bainite observed. As a result, both the low temperature simulated forged products and high temperature simulated forged products had Charpy impact values of not more than 10 J/cm$^2$, relative yield strengths Rys of not less than 110%, and relative tensile strengths Rts of not more than 100%.

On the other hand, in Test Nos. 20 and 28, the V contents of the steels were too low. As a result, the low temperature simulated forged products and high temperature simulated forged products all had relative yield strengths Rys of less than 110%.

In Test Nos. 21 and 24, the contents of the elements in the steels were appropriate but fn1s were less than 0.65. As a result, the low temperature simulated forged products and high temperature simulated forged products all had relative yield strengths Rys of less than 110%.

In Test Nos. 22 and 25, the contents of the elements were appropriate but fn1s were more than 0.80. As a result, the low temperature simulated forged products and high tem-

TABLE 3

| | Low temperature simulated forged product | | | | High temperature simulated forged product | | | | Reference product | | | |
|---|---|---|---|---|---|---|---|---|---|---|---|---|
| Test No. | Structure | Charpy impact value (J/cm$^2$) | Rys (%) | Rts (%) | Structure | Charpy impact value (J/cm$^2$) | Rys (%) | Rts (%) | Structure | Charpy impact value (J/cm$^2$) | Rys (%) | Rts (%) |
| 1 | F + P | 3.2 | 111 | 82 | F + P | 3.4 | 115 | 87 | — | — | — | — |
| 2 | F + P | 3.4 | 115 | 87 | F + P | 3.6 | 124 | 91 | — | — | — | — |
| 3 | F + P | 4.2 | 119 | 90 | F + P | 4.0 | 127 | 94 | — | — | — | — |
| 4 | F + P | 5.1 | 116 | 85 | F + P | 5.0 | 117 | 90 | — | — | — | — |
| 5 | F + P | 5.1 | 130 | 97 | F + P | 4.9 | 136 | 99 | — | — | — | — |
| 6 | F + P | 4.6 | 116 | 87 | F + P | 5.2 | 120 | 93 | — | — | — | — |
| 7 | F + P | 4.2 | 117 | 89 | F + P | 4.3 | 124 | 91 | — | — | — | — |
| 8 | F + P | 4.8 | 117 | 89 | F + P | 4.5 | 125 | 93 | — | — | — | — |
| 9 | F + P | 5.4 | 118 | 88 | F + P | 5.0 | 125 | 91 | — | — | — | — |
| 10 | F + P | 4.8 | 119 | 90 | F + P | 4.6 | 127 | 93 | — | — | — | — |
| 11 | F + P | 3.2 | 129 | 95 | F + P | 3.0 | 133 | 98 | — | — | — | — |
| 12 | F + P | 4.9 | 123 | 90 | F + P | 5.9 | 130 | 96 | — | — | — | — |
| 13 | F + P | 5.6 | 127 | 95 | F + P | 5.2 | 132 | 98 | — | — | — | — |
| 14 | F + P | 4.8 | 122 | 91 | F + P | 4.7 | 129 | 96 | — | — | — | — |
| 15 | F + P | 5.1 | 124 | 93 | F + P | 5.1 | 127 | 95 | — | — | — | — |
| 16 | F + P | 4.2 | 121 | 90 | F + P | 4.3 | 131 | 96 | — | — | — | — |
| 17 | F + P | 4.5 | 124 | 92 | F + P | 4.4 | 128 | 96 | — | — | — | — |
| 18 | F + P | 3.6 | 113 | 86 | F + P | 3.4 | 119 | 91 | — | — | — | — |
| 19 | F + P | 3.5 | 119 | 92 | F + P | 3.6 | 126 | 96 | — | — | — | — |
| 20 | F + P | 3.8 | **101 | 75 | F + P | 5.2 | **103 | 78 | — | — | — | — |
| 21 | F + P | 6.2 | **103 | 76 | F + P | 4.6 | **105 | 79 | — | — | — | — |
| 22 | F + P | 5.8 | 122 | **101 | F + P | 5.6 | 127 | **106 | — | — | — | — |
| 23 | F + P | **14.8 | 110 | 84 | F + P | **14.9 | 112 | 86 | — | — | — | — |
| 24 | F + P | 5.2 | **106 | 81 | F + P | 4.6 | **106 | 80 | — | — | — | — |
| 25 | F + P | 5.4 | 125 | **102 | F + P | 4.3 | 129 | **108 | — | — | — | — |
| 26 | F + P | 4.3 | 129 | **105 | F + P | 3.6 | 132 | **107 | — | — | — | — |
| 27 | F + P | **15.6 | 116 | 88 | F + P | **15.0 | 120 | 89 | — | — | — | — |
| 28 | F + P | 5.4 | **102 | 77 | F + P | 5.2 | **106 | 80 | — | — | — | — |
| 29 | **F + P + B | **14.6 | 118 | 92 | **F + P + B | **45.2 | 121 | 90 | — | — | — | — |
| 30 | F + P | 3.5 | **103 | 76 | **F + P + B | **16.3 | 111 | **102 | — | — | — | — |
| 31 | F + P | 3.3 | **105 | 78 | F + P | 3.6 | 112 | 95 | — | — | — | — |
| 32 | F + P | 4.1 | 113 | 83 | **F + P + B | **15.8 | 110 | **101 | — | — | — | — |
| 33 | F + P | 4.5 | 114 | 88 | **F + P + B | **16.1 | 111 | **104 | — | — | — | — |
| 34 | F + P | 5.1 | **104 | 74 | F + P | 5.2 | 111 | 98 | — | — | — | — |
| 35 | F + P | 5.2 | 112 | 76 | **F + P + B | **14.2 | 113 | **105 | — | — | — | — |
| 36 | F + P | 4.2 | **106 | 78 | **F + P + B | **19.3 | 112 | **104 | — | — | — | — |
| 37 | F + P | 4.8 | **102 | 72 | F + P | 4.8 | 119 | 97 | — | — | — | — |
| 38 | F + P | 4.5 | 115 | 88 | **F + P + B | **13.2 | 115 | **102 | — | — | — | — |
| 39 | F + P | 5.2 | 114 | 85 | **F + P + B | **16.8 | 114 | **105 | — | — | — | — |
| 40 | F + P | 3.2 | **102 | 72 | F + P | 5.6 | 118 | 99 | — | — | — | — |
| 41 | F + P | 4.3 | 115 | 76 | **F + P + B | **13.8 | 113 | **107 | — | — | — | — |
| 42 | — | — | — | — | — | — | — | — | F + P | 9.5 | **100 | 100 |

1) Symbol "**" indicates failure to meet the target.

perature simulated forged products all had relative tensile strengths Rts of more than 100%.

In Test Nos. 23 and 27, the Ti contents in the steels were too low. As a result, the low temperature simulated forged products and high temperature simulated forged products had Charpy impact values of more than 10 J/cm$^2$ and therefore had low fracture splittabilities.

In Test No. 26, the C content was too high. As a result, the low temperature simulated forged product and high temperature simulated forged product had relative tensile strengths Rts of more than 100% and therefore had low machinability.

In Test No. 29, the Mo content was too high. As a result, bainite was observed in the microstructure. Furthermore, very small amounts of ferrite and pearlite were observed. In Test No. 29, the low temperature simulated forged product and high temperature simulated forged product had Charily impact values of more than 10 J/cm$^2$ and therefore had low fracture splittability.

In Test Nos. 30 and 36, the chemical compositions were appropriate and the fn1 values were within the range of 0.65 to 0.80. However, the heating temperatures Tf were too low. As a result, the V fractions Rv were too high and the Ti fractions Rti were too low. Consequently, the low temperature simulated forged products had excessively low relative yield strengths Rys. Furthermore, in the microstructures of the high temperature simulated forged products, bainite was observed. As a result, the Charpy impact values were more than 10 J/cm$^2$ and therefore the fracture splittabilities were low. Furthermore, the relative tensile strengths Rts were more than 100% and therefore the machinabilities were low.

In Test Nos. 31 and 37, the chemical compositions were appropriate and the fn1 values were within the range of 0.65 to 0.80. However, the water cooling times tw were too short. As a result, the V fractions Rv were too high. Consequently, the low temperature forged products had low relative yield strengths Rys.

In Test Nos. 32 and 38, the chemical compositions were appropriate and the fn1 values were within the range of 0.65 to 0.80. However, the water cooling times tw were too long. As a result, the Ti fractions Rti were too low. Furthermore, in the microstructures of the high temperature simulated forged products, bainite was observed. As a result, the Charpy impact values were more than 10 J/cm$^2$ and therefore the fracture splittabilities were low. Furthermore, the relative tensile strengths Rts were more than 100% and therefore the machinabilities were low.

In Test Nos. 33 and 39, the chemical compositions were appropriate and the fn1 values were within the range of 0.65 to 0.80. However, the rolling rates Vr were too slow. As a result, the Ti fractions Rti were too low. Furthermore, in the microstructures of the high temperature simulated forged products, bainite was observed. As a result, the Charpy impact values were more than 10 J/cm$^2$ and therefore the fracture splittabilities were low. Furthermore, the relative tensile strengths Rts were more than 100% and therefore the machinabilities were low.

In Test Nos. 34 and 40, the chemical compositions were appropriate and the fn1 values were within the range of 0.65 to 0.80. However, the rolling rates Vr were too fast. As a result, the V fractions Rv were too high. Consequently, the low temperature forged products had low relative yield strengths Rys.

In Test Nos. 35 and 41, the chemical compositions were appropriate and the fn1 values were within the range of 0.65 to 0.80. However, the heating temperatures Tf were too high. As a result, the Ti fractions Rti were too low. Consequently, the low temperature simulated forged products had excessively low relative yield strengths Rys. Furthermore, in the microstructures of the high temperature simulated forged products, bainite was observed. As a result, the Charpy impact values were more than 10 J/cm$^2$ and therefore the fracture splittabilities were low.

In the foregoing specification, an embodiment of the present invention has been described. However, the embodiment described above is merely an example for implementing the present invention. Thus, the present invention is not limited to the embodiment described above, and modifications of the embodiment described above may be made appropriately for the implementation without departing from the scope of the invention.

The invention claimed is:

1. A rolled steel material for fracture splitting connecting rods, the rolled steel material having a chemical composition consisting of, in mass %, C: 0.30 to 0.40%,
Si: 0.60 to 1.00%,
Mn: 0.50 to 1.00%,
P: 0.04 to 0.07%,
S: 0.04 to 0.13%,
Cr: 0.10 to 0.30%,
V: 0.05 to 0.14%,
Ti: more than 0.15% to 0.20% or less,
N: 0.002 to 0.020%,
Cu: 0 to 0.40%,
Ni: 0 to 0.30%,
Mo: 0 to 0.10%,
Pb: 0 to 0.30%,
Te: 0 to 0.30%,
Ca: 0 to 0.010%, and
Bi: 0 to 0.30%,
the balance being Fe and impurities,
wherein fn1, defined by Formula (1), ranges from 0.65 to 0.80,
wherein a V content in coarse precipitates having a particle size of 200 nm or more is 70% or less relative to the V content in the rolled steel material for fracture splitting connecting rods, and
wherein a Ti content in the coarse precipitates is 50% or more relative to the Ti content in the rolled steel material for fracture splitting connecting rods:

$$fn1=C+Si/10+Mn/5+5Cr/22+(Cu+Ni)/20+Mo/2+33V/20-5S/7 \quad \text{Formula (1)}$$

where each element symbol in Formula (1) is substituted by the content (mass %) of a corresponding element or is substituted by "0" in a case where the corresponding element is not present.

2. The rolled steel material for fracture splitting connecting rods according to claim 1, wherein the chemical composition contains one or more selected from the group consisting of, Cu: 0.01 to 0.40%,
Ni: 0.01 to 0.30%, and
Mo: 0.01 to 0.10%.

3. The rolled steel material for fracture splitting connecting rods according to claim 1, wherein the chemical composition contains one or more selected from the group consisting of, Pb: 0.05 to 0.30%,
Te: 0.0003 to 0.30%,
Ca: 0.0003 to 0.010%, and
Bi: 0.0003 to 0.30%.

4. The rolled steel material for fracture splitting connecting rods according to claim 2, wherein the chemical composition contains one or more selected from the group consisting of, Pb: 0.05 to 0.30%, Te: 0.0003 to 0.30%, Ca: 0.0003 to 0.010%, and Bi: 0.0003 to 0.30%.

* * * * *